US008171688B2

(12) United States Patent
Junker

(10) Patent No.: US 8,171,688 B2
(45) Date of Patent: May 8, 2012

(54) WOODEN BUILDING ELEMENT FOR CONSTRUCTING THE WALLS OF A BUILDING

(75) Inventor: Dieter Junker, Nordrach (DE)

(73) Assignee: Junker Holding GmbH, Nordrach (DE)

( * ) Notice: Subject to any disclaimer, the term of this patent is extended or adjusted under 35 U.S.C. 154(b) by 694 days.

(21) Appl. No.: 12/086,301

(22) PCT Filed: Aug. 24, 2006

(86) PCT No.: PCT/EP2006/008324

§ 371 (c)(1),
(2), (4) Date: Apr. 14, 2009

(87) PCT Pub. No.: WO2007/068297

PCT Pub. Date: Jun. 21, 2007

(65) Prior Publication Data

US 2009/0277120 A1 Nov. 12, 2009

(30) Foreign Application Priority Data

Dec. 13, 2005 (WO) ..... PCT/EP2005/013330
Apr. 7, 2006 (DE) ..... 10 2006 016 838

(51) Int. Cl.

| | |
|---|---|
| ***E04B 2/10*** | (2006.01) |
| ***E04B 2/08*** | (2006.01) |
| ***E04B 2/46*** | (2006.01) |
| ***E04B 2/48*** | (2006.01) |

(52) U.S. Cl. ..... 52/426; 52/424; 52/564; 52/562; 52/233

(58) Field of Classification Search ..... 52/284, 52/285.1, 286, 598, 596, 415, 421, 424, 431, 52/426, 425, 562, 564, 563

See application file for complete search history.

(56) References Cited

U.S. PATENT DOCUMENTS

| | | | | |
|---|---|---|---|---|
| 3,286,428 | A * | 11/1966 | Kay | 52/481.1 |
| 3,547,472 | A * | 12/1970 | Ehrman | 403/381 |
| 3,603,060 | A * | 9/1971 | Kay | 52/281 |
| 4,091,590 | A * | 5/1978 | Miura | 52/591.5 |

(Continued)

FOREIGN PATENT DOCUMENTS

| | | |
|---|---|---|
| AU | 500292 | 12/1976 |
| DE | 10224903 A1 | 6/2004 |
| EP | 0383693 | 8/1990 |
| EP | 0744507 | 11/1996 |

(Continued)

OTHER PUBLICATIONS

International Search Report dated Dec. 15, 2006.

*Primary Examiner* — Phi Dieu Tran A
(74) *Attorney, Agent, or Firm* — Jacobson Holman PLLC

(57) ABSTRACT

A wooden building element for producing planar constructions, especially for constructing the upright walls of a building. Also, a corner building element adapted to the wooden building element and to a building constructed using the elements. The wooden building elements have two approximately rectangular support bases and two wall panels that are approximately equal in area. The support bases are maintained at a distance from each other by a plurality of supports that are aligned vertically in relation to the finished building and that delimit an interior compartment for the insertion of insulating material and building installations. The wall panels are fastened to the outer surfaces of the support bases and are set off therefrom in relation to longitudinal edges that are aligned approximately horizontally to the finished building and high edges that are aligned approximately vertically.

18 Claims, 4 Drawing Sheets

U.S. PATENT DOCUMENTS

| | | | | |
|---|---|---|---|---|
| 4,694,624 | A * | 9/1987 | Juhas | 52/223.7 |
| 4,854,103 | A | 8/1989 | Klym | |
| 6,122,880 | A | 9/2000 | Kolb et al. | 52/592.6 |
| 2006/0168904 | A1 * | 8/2006 | Muszynski | 52/233 |

FOREIGN PATENT DOCUMENTS

| | | | |
|---|---|---|---|
| GB | 2159552 | A * | 12/1985 |
| WO | WO 95/20709 | | 8/1995 |
| WO | WO 03/102325 | A2 | 12/2003 |

* cited by examiner

WOODEN BUILDING ELEMENT FOR CONSTRUCTING THE WALLS OF A BUILDING

This is a national stage of PCT/EP06/008324 filed Aug. 24, 2006 and published in German.

FIELD OF THE INVENTION

The invention concerns a wooden structural component for manufacturing flat structures, in particular for the construction of upright walls of buildings with rectangular base plates of roughly equal area, arranged roughly parallel to each other, which are held, overlapping and projected normal to their main surfaces, by intermediate members at a distance from each other, and between which cover a cavity, with rectangular wall panels of roughly equal area, arranged roughly parallel to each other, which are fastened, overlapping and projected normal to their main surfaces, on the outside of the base plates, and are roughly the same size as, or slightly smaller than, the base plates, such that both the base plates and the wall panels on the finished structure are arranged horizontally, longitudinal edges roughly parallel to each other, and arranged roughly vertical on the finished structure, featuring top edges roughly parallel to each other, such that the wall panels are arranged offset to the base plates as regards their longitudinal edges and regards their top edges, such that—through longitudinal edges and top edges on the one hand, and through longitudinal edges and top edges of the wall panels removed from them on the other—bounded, exposed longitudinal frames and top frames of the base plates form the sides of two male part or tongue joints arranged roughly at right angles to each other, and that longitudinal frames of the wall panels lying opposite to each other and protruding over longitudinal edges of the base plates, and wall panel top frames lying opposite to each other and protruding over top edges of the base plates form the sides of two female part or groove joints arranged roughly at right angles to each other, roughly as the opposites of the male part or tongue joints, of which intermediate members feature rod-like, longitudinally-stretched supports which are arranged roughly parallel to each other and to top edges of the base plates on a side, and are arranged roughly perpendicular to the longitudinal edges of the base plates, and which are distributed at roughly the same distance from each other in the cavity between the base plates, and whose length is roughly the same as the length of the top edges of the base plates or wall panels on the side, such that the supports arranged between the same two base plates and joined directly to these, aligned roughly parallel to each other and to the top edges of the base plates, are arranged at the same distances as a specific grid dimension from each other, and such that a distance of a first support from the nearest top edge of the base plates directly joined to this first support, and a second distance of a last support to the nearest top edge of the base plate directly joined to this last support, complement each other to the full grid dimension, such that the supports feature a rectilinear mid-profile with an essentially right-angled cross section, and form retaining walls between the base plates roughly at right angles to it, which subdivide the cavity between the base plates into chambers of roughly equal length and breadth and such that the supports feature tongue joints, preferably dovetail joints, along their edge sides, which fit into roughly equal and opposite grooves, preferably corresponding dovetail grooves on the inner surface of the base plates, and so form a form-fitting tongue-groove connection or a twofold form-fitting dovetail connection between supports and base plates.

BACKGROUND OF THE INVENTION

A wooden structural component of the type named has been made known by DE 102 24 903 A1, by WO 2003 102 325 A3 and by EP 1 511 906.

The subject of the invention is also a corner structural component for insertion in a construction set and a structure in connection with wooden structural components of the type named. The structure according to the invention features corner structural components and wooden structural components in a particular insert with insulating material.

Wooden structural components of the type named are originally specified for structures with particularly advantageous thermodynamic properties as regards the heat and moisture permeability of their building walls. They can be manufactured with little economic outlay in the form of materials and labor, and have proved themselves optimally in the construction of building in areas with moderate hazards. Particular influences of earthquakes (tectonics), atmospheric conditions, industry and traffic or tremors as a result of warfare, for example hazards caused by seismic shocks, water penetration, whirlwinds or tornados and arbitrarily effected operations in the surrounding area require particular properties which, until now, structures of the type named initially could only achieve provisionally and only with substantial economic outlay. The general task now underlying the invention is to create structures which can be erected at little economic cost, which satisfy high structural-physical requirements and which in particular withstand the hazards named.

As was expected, what has been established about known wooden structural components of the type named, both in research areas and in industrial usage, is that the join between neighboring wooden structural components in walls of buildings, compared to mechanical influences in the direction normal to the walls of the buildings, is very robust, and satisfies even the strictest requirements of the greatest hazards. Nevertheless, it also turned out that particularly large mechanical forces can emerge in buildings in the hazardous surrounding area, too, which act in the direction along the walls of the buildings and put a high strain on the join between the wooden structural components neighboring each other. Thus a particular task of the invention consists in further developing the known wooden structural component without loss to its advantageous properties so that—without particular economic cost in terms of materials and labor—it can be joined to wooden structural components of the same type in walls of buildings which withstand the effect of large forces in all directions, in particular also the effect of large shear forces in the direction along the walls of the buildings.

SUMMARY OF THE INVENTION

The solution to the particular technical task, according to the invention, is given in the essential inventive characteristics of the wooden structural component of the type initially named include the supports which are aligned roughly parallel to the top edges of the base plates and are of roughly equal length being arranged consistently in relation to the longitudinal edges of the base plates, with their tongue joints along their edge side and engaging partially into the equal and opposite grooves on the base plates, and so the base plates located opposite each other joining partially together, the supports featuring free end pieces of roughly the same length with free tongue joints of the same length which protrude over a first of two longitudinal front sides of the base plates located opposite each other, longitudinal front sides which are each bordered by the two longitudinal edges of the base plates nearest each other, and the grooves which are roughly equal and opposite to the tongue joints on the edge sides of the supports preferably featuring dovetail grooves in the free end pieces of the base plates, which are accessible by a second of the two longitudinal front sides of the base plates located opposite each other, and which are set up in each case to incorporate the free tongue joint on the finished structure, preferably the dovetail joint of one of the free end pieces of supports of a neighboring wooden structural component of the same type.

According to the invention, the tongue joints of the supports of a wooden structural component only grip partially into the otherwise equal and opposite grooves of the base plates of the same wooden structural component. The base plates of a single wooden structural component according to the invention are therefore no longer just as firmly joined together as the base plates of the known wooden structural component inserted up until now, that is, before the further development according to the invention. The required firmness between the base plates of a wooden structural component according to the invention nevertheless arises, however, in connection with neighboring equal wooden structural components in finished walls of buildings by the free end pieces of the supports of a neighboring wooden structural component protruding into the cavity of the one wooden structural component, and the free tongue joints on the free end pieces of the supports of the neighboring wooden structural component gripping into the free end piece of the equal and opposite grooves on the base plates of the one wooden structural component. If tongue and groove make up a dovetail joint on supports or base plates, then there is a firm connection between base plates located next to each other without the use of glue.

Shear forces will in any case be transmitted effectively by one wooden structural component to the neighboring wooden structural component in a direction along the building walls over the free end pieces of the grooves in the base plates of the one wooden structural component, and over the free tongue joints of the free end pieces of the supports of the neighboring wooden structural component engaging therein. For the transmission of forces, for example wind pressure in the direction normal to walls of buildings, according to wooden structural components as further developed by the invention, longitudinal edges and top edges of the base plates of the one wooden structural component are located between the sides of the longitudinal edges and top edges of wall panels of neighboring wooden structural components, as hitherto. In the further development of the known wooden structural components according to the invention, their technical and economic advantages remain completely retained and are supplemented by further technical advantages. The transmission of shear forces in the direction along a building wall of a wooden structural component onto a neighboring wooden structural component is certainly a known technical task and was already a goal being aspired towards by known technologies. For example, according to EP 0744507 B1 and in WO 97/39204, such shear forces in the longitudinal direction are transmitted by protrusions or points on the end of so-called module cores of a wooden structural component in connection with grooves or holes on the other ends of the same module cores of neighboring wooden structural components. These module cores are admittedly composed of several pieces and in any case can only be manufactured at great economic cost in terms of material, profiling and labor. On the other hand, according to the invention, the transmission of shear forces in the longitudinal direction takes place by supports of a wooden structural component which are very easy to manufacture and introduce, directly onto equally easily manufacturable base plates of neighboring wooden structural components. In contrast to the stated prior art, the supports and base plates and wall panels according to the invention form a surprisingly economically manufacturable combination and display particularly advantageous functional interactions of structural engineering.

In the cavities between the base plates of the wooden structural components according to the invention, without particular fixtures, individual installation channels for electricity, gas, drinking and effluent water, telecommunications or similar can certainly be built in during the construction of structures, and finally embedded in insulating materials if such installation channels are planned in due time before the erection of the structure. All the same, most installations are only planned after the erection of the structure, and must then be fixed to the outer sides of the wall panels covering the base plates, and must be covered by a further plaster wall.

In the interests of economic efficiency, the function of the wooden structural component according to the invention is also to be considered as a bearer of the conventional installations. From this there results the particular task for the further development of the invention: demarcating, in any order and without particular pre-planning, usable installations spaces in the cavity between the base plates, in such a way that structurally conventional installations are aligned without additional covering plaster walls, and can later be investigated and replaced without further ado.

In general, the solution to the task regarding lasting installation spaces consists in aligned partition walls being introducible between the supports, roughly parallel to the base plates, which, in the finished structure, feature roughly horizontally-aligned longitudinal edges and vertically-aligned top edges, and are held on both sides along their vertical top edges by the retaining walls of the supports which are turned towards each other. These partition walls should separate installation spaces turned towards inner base plates, and wall panels with little depth, from installation spaces turned towards outer base plates and wall panels which feature a large depth. The partition walls are preferably constructed with top frames running along their top edges, which are made to engage in notches on the retaining walls of the supports. The notches on the retaining walls should have an opening width in the range from 3 to 8 millimeters, in order to incorporate the top edges of partition walls made of wood fiberboard. Moreover, they should advantageously feature a gap of 20 to 30 millimeters, preferably from 20 to 25 millimeters, from an inner base plate, and a gap of 150 to 250 millimeters, preferably roughly 200 millimeters, from an outer base plate.

Co-ordinated to the particular requirements of the wooden structural components, the essentially rectangular-constructed partition walls feature lateral top edges with a length equal to the length of the supports, and are inserted between the supports in such a way that their longitudinal edges are arranged flush with the ends of the supports. The partition walls so arranged do not thereby disrupt the construction of a building wall by assembly of the wooden structural components. Hence a complete delimiting of installation spaces from insulation spaces only arises through the joining together of the wooden structural components to a finished building wall.

Wooden structural components according to the invention can be particularly advantageously utilized in connection with particularly adapted corner structural components.

BRIEF DESCRIPTION OF THE DRAWINGS

The invention will now be described in more detail using the examples of particular embodiment types with the help of attached drawings. Schematically shown in the drawings are.

DETAILED DESCRIPTION OF THE PREFERRED EMBODIMENTS

Figure 1:
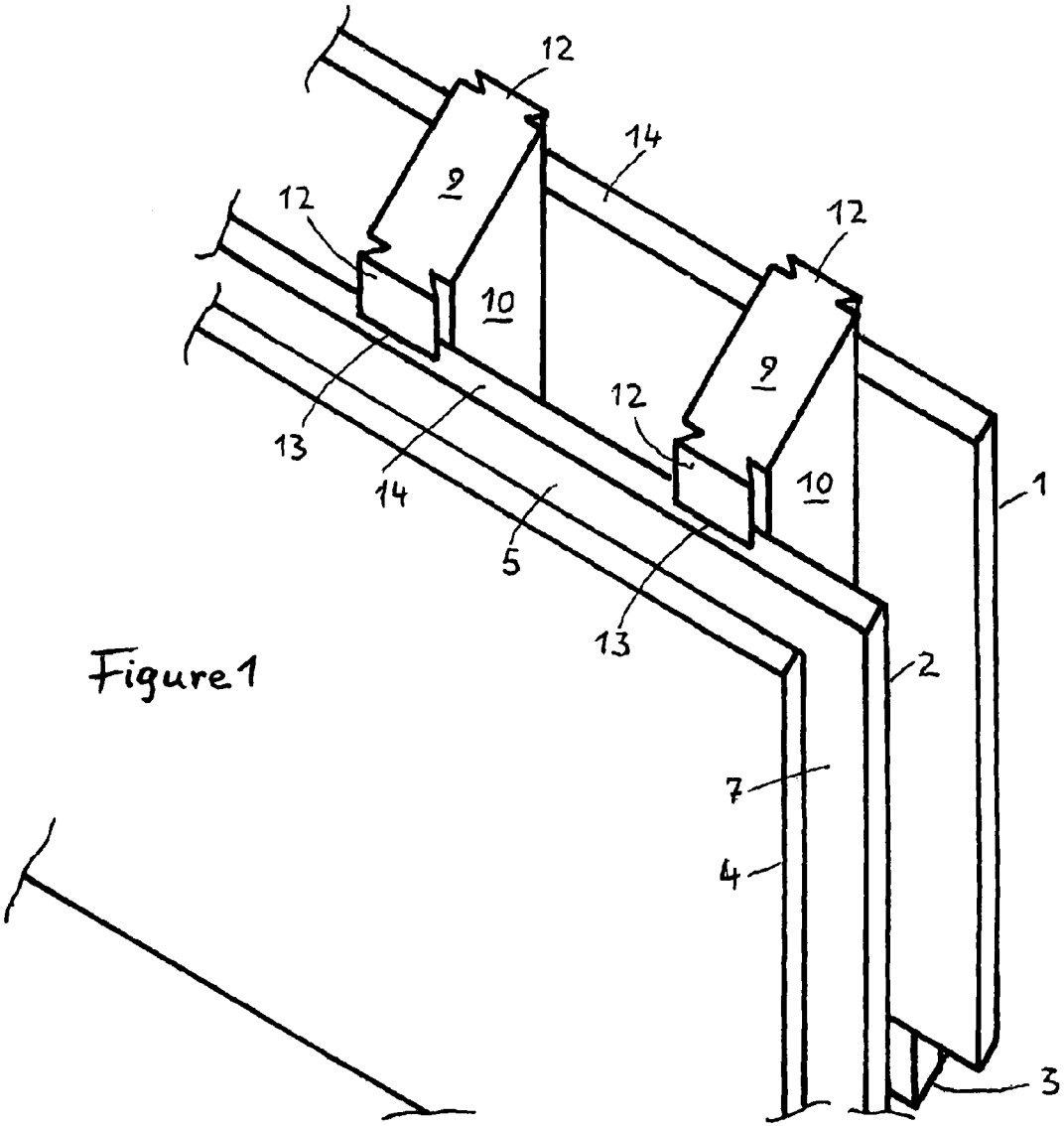
FIG. 1: a section of a perspective view of a wooden structural component according to the invention.

The same and similar constituents of the wooden structural component according to the invention and of the corner structural component are provided with the same labels in all the figures of the drawings, and are described together in the following description for all the embodiment types schematically represented in the drawings.

The wooden structural elements depicted in FIGS. 1 to 5 feature two base plates 1 and 2, which are constructed rectangular with roughly the same area, aligned roughly parallel to each other, and arranged with a distance between them and in a projection normal to their main surfaces, overlapping each other. Rectangular wall panels 3 and 4, of equal area, overlapping each other and in a projection normal to their main surfaces, are each fixed to one of the outer main surfaces of the base plates. The wall panels feature main surfaces which are either the same size as or slightly smaller than the main surfaces of the base plates. On the finished structure, both the base plates and the wall panels feature top edges which are aligned roughly horizontal and are roughly parallel to each other, and, laterally on the finished structure, top edges which are aligned roughly vertical and are roughly parallel to each other. The wall panels are arranged opposite the base plates offset in such a way that longitudinal edges of the base plates and wall panels, roughly parallel to each other, delimit a free longitudinal edge 5 on the outer surfaces of the base plates on the one hand, and a free longitudinal edge 6 on the inner surface of the wall panels on the other hand. Moreover, the wall panels are also arranged opposite the base plates in such a way that top edges of the base plates and wall panels roughly parallel to each other delimit a free top edge 7 on the outer surfaces of the base plates on the one hand, and a free top edge 8 on the inner surfaces of the wall panels on the other hand.

The base plates 1 and 2 of the wooden structural components depicted in the FIGS. 1 to 5 are held by four rod-like, elongated supports 9 at a distance from one another. The supports are aligned roughly parallel to each other and to lateral top edges of the base plates, and roughly perpendicular to the longitudinal edges of the base plates, and in a row at equal distances from each other. These distances are determined by a grid dimension which is manufactured again by the sum of the distances of the two outer supports in the row to the top edges of the base plates nearest to them.

The supports 9 feature a rectilinear mid-profile with an essentially rectangular cross-section and form retaining walls 10 between the base plates and roughly perpendicular to them, which subdivide the cavity between the base plates into chambers of roughly the same length and breadth. Dovetail grooves 11 aligned roughly parallel to the base plates can be designated to the retaining walls, into which bolts (not shown) for joining neighboring wooden structural components are to be inserted.

The supports 9 feature dovetail joints 12 along their edge sides which engage into roughly equal and opposite dovetail grooves 13 on the inner surfaces of the base plates 1 and 2, and so form a twofold form-fit connection between supports and base plates.

Figure 2:
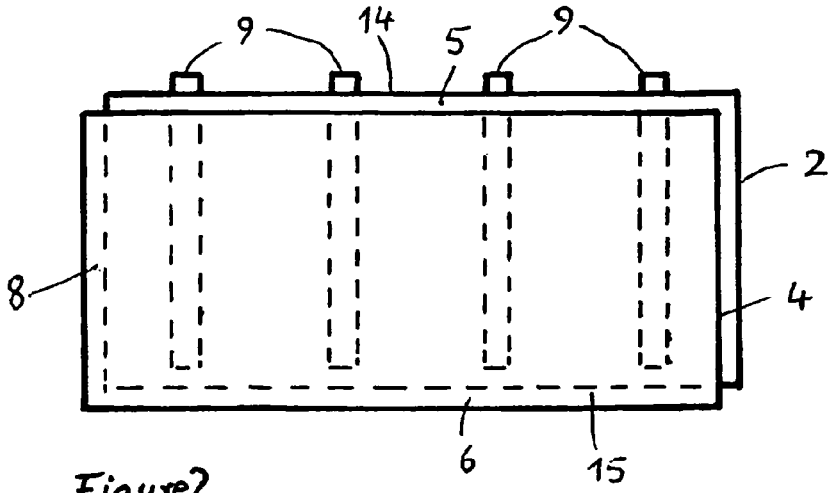
FIG. 2: the front view of a wooden structural component of the type shown in FIG. 1, in a direction normal to the main surfaces of wall panels and base plates.
Figure 3:
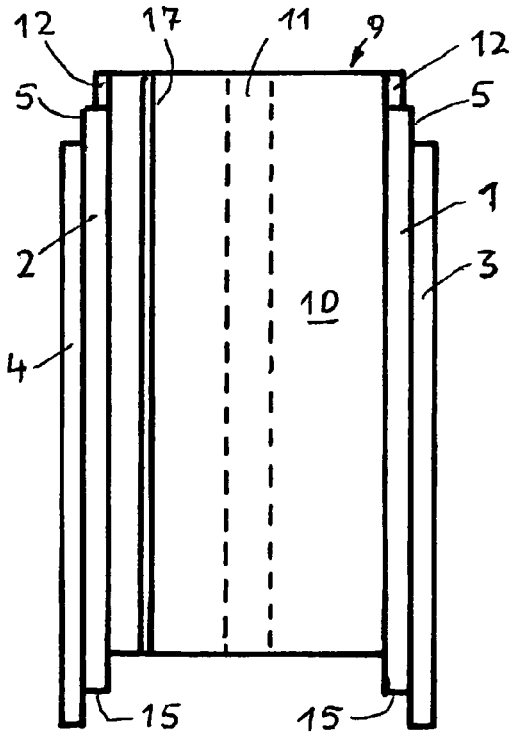
FIG. 3: the side view of a first type of embodiment of the wooden structural component in a direction normal to the retaining walls of supports.

It can be seen from FIGS. 1 to 3 of the drawings that the roughly equally long supports 9 aligned roughly parallel to the top edges of the base plates 1 and 2 are consistently arranged offset upwards in relation to the longitudinal edges of the base plates 1 and 2, with their dovetail joints 12 along their edge sides only partially engaging into the equal and opposite dovetail grooves 13 of the same length on the base plates, and so the base plates located opposite each other only join partially together. The supports feature roughly equally long free end pieces with equally long free dovetail joints, which protrude consistently over an upper longitudinal front side 14 delimited by the upper longitudinal edges of the base plates. Through the displacement of the supports in relation to the longitudinal edges, equally long end pieces of the dovetail grooves 13 remain free on the inner surfaces of the base plates. These end pieces are accessible by a lower longitudinal front side 15 which is delimited by the lower longitudinal edges of the base plates, and is dedicated to incorporating the free dovetail profiles of the free end pieces of supports of neighboring wooden structural elements in combination with a finished building wall.

Figure 4:
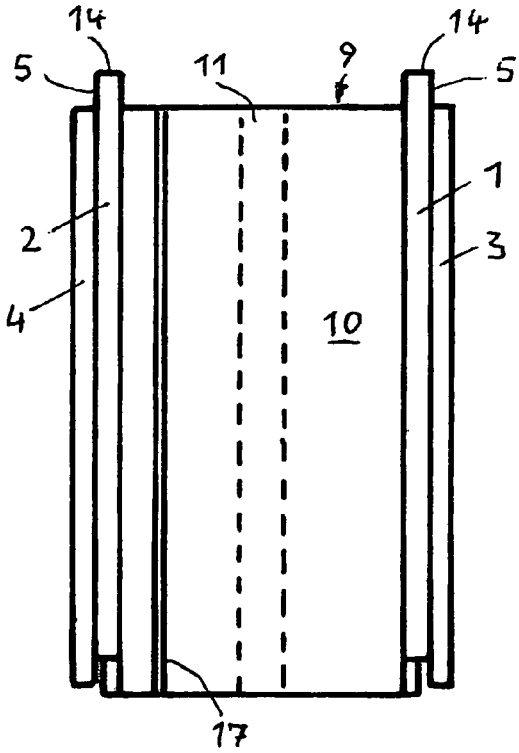
FIG. 4: the side view of a second type of embodiment of the wooden structural component according to the invention, in a direction normal to the retaining walls of supports.

Emerging from FIG. 4 of the drawings is a modified embodiment type of the wooden structural component according to the invention. Similar to the embodiment type as per FIGS. 1 and 3 of the drawings, the roughly equally long supports 9 aligned parallel to the top edges of base plates 1 and 2 are arranged consistently offset in relation to the longitudinal edges of base plates 1 and 2. With their dovetail joints 12 along their edge sides, they engage only partially into the equally long, equal and opposite dovetail grooves 13 on the base plates, and so only partially join the base plates located opposite each other. The supports also feature roughly equally long free end pieces with equally long free dovetail joints and release equally long end pieces of the dovetail grooves 13 on the inner surfaces of the base plates. Finally, in the modified embodiment type according to FIG. 4, the free end pieces of the grooves are dedicated to incorporating the free dovetail profiles of the free end pieces of supports of neighboring wooden structural components in the composite of a finished building wall.

The embodiment type according to FIG. 4 differentiates itself from those according to FIGS. 1 to 3 by the fact that the supports 9 are arranged offset not upwards but downwards in relation to the longitudinal edges of the base plates 1 and 2. Their free end pieces with the free dovetail joints accordingly protrude not over the upper longitudinal front side 14 but rather over the lower longitudinal front side 15, and the free end pieces of the dovetail grooves 13 are accessible from the upper longitudinal front side 14. This modified embodiment type has the advantage that the free end pieces of the supports and their free dovetail joints are located protected between the free longitudinal frames 6 of the wall panels which protrude over the lower longitudinal edges of the base plates.

Figure 5:
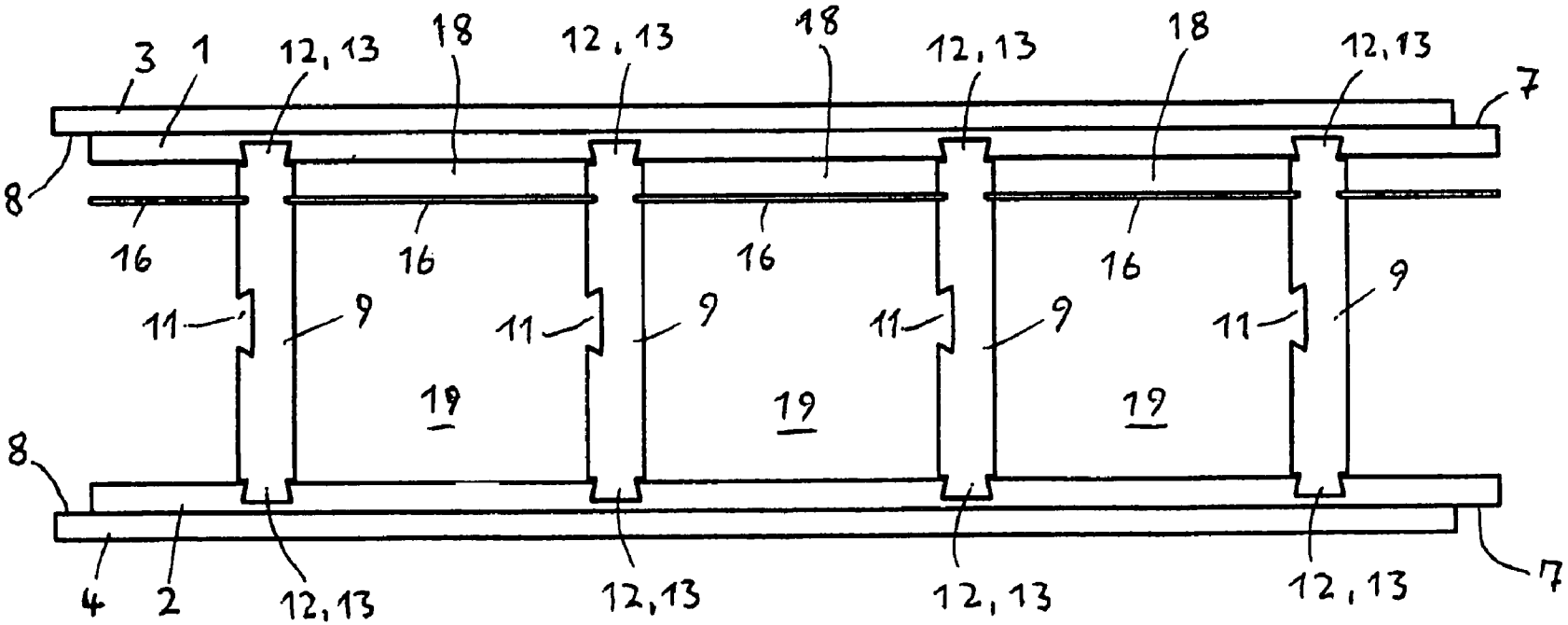
FIG. 5: the top view of a wooden structural component of the type according to FIG. 1 to 4 with inserted partition walls for dividing installation spaces from insulation spaces.

The wooden structural component depicted in FIG. 5 features roughly rectangular-built partition walls 16 which are inserted between the supports 9 and aligned roughly parallel to the base plates 1 and 2, and features roughly horizontally aligned longitudinal edges and vertically-aligned top edges on the finished structure. The longitudinal edges of the partition walls are longer than the free distance between two supports by the width of two top edges. These top frames along the top edges of the partition walls project into equal and opposite grooves 17 which are located in the retaining walls 10 of the supports. By the combination between the edges and grooves, the partition walls on the supports between the base plates are established and separate installation spaces 18 of small depth from insulation spaces 19 of large depth.

The partition walls 16 of the wooden structural component according to FIG. 5 are preferably manufactured out of wood fibreboards. The grooves 17 on the retaining walls 10 preferably feature an opening width in the range from 3 to 8 millimeters. The depth of the installation spaces comes to 20 to 30 millimeters, preferably 20 to 25 millimeters, corresponding to the distance of the grooves from the one base plate. Corresponding to the distance of the grooves from the other base plate, the insulation spaces feature a depth of 150 to 250 millimeters, preferably around 200 millimeters. If the longitudinal edges of the partition walls are arranged between the supports according to the invention flush to the ends of the supports, then the partition walls do not take part in a form-fitting connection between neighboring wooden structural components, and so require neither precision in their measurements on the top edges and grooves 17, nor particular attentiveness during the erection of structures.

The manufacture of static and thermodynamically consistent structures with installation spaces in their walls, which are later freely available, only requires a small economic outlay. The wooden structural components inserted for that do not have to be constructed with particularly large dimensions, because the installation spaces together with the partition walls which separate the installation spaces from isolation spaces according to the invention already considerably reduce the heat and mass transfer to the structures and so complement the insulation of the insulation spaces. The expenditure for construction, material, manufacture and transport of the wooden structural components to the building site, and the assignment of labor on the building site for the erection of a structure, are not considerably influenced by the manufacture according to the invention of the insulation spaces in the walls later freely available.

Figure 7:
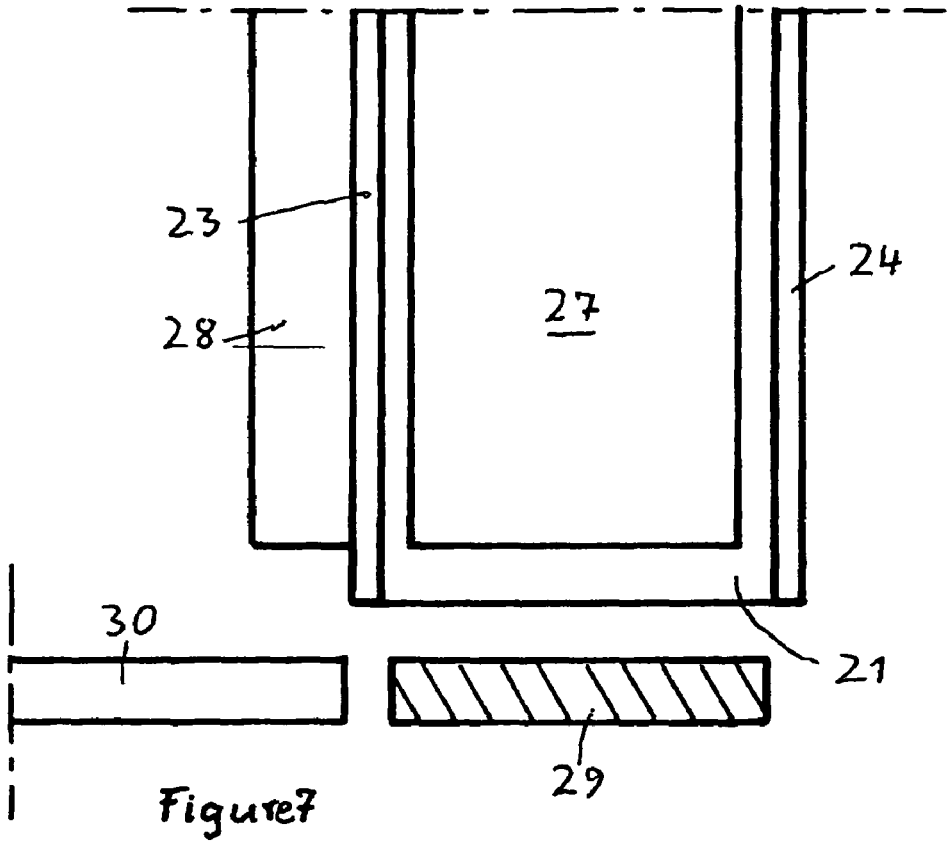
FIG. 7: a section from the front view of a corner structural component according to FIG. 6.
Figure 6:
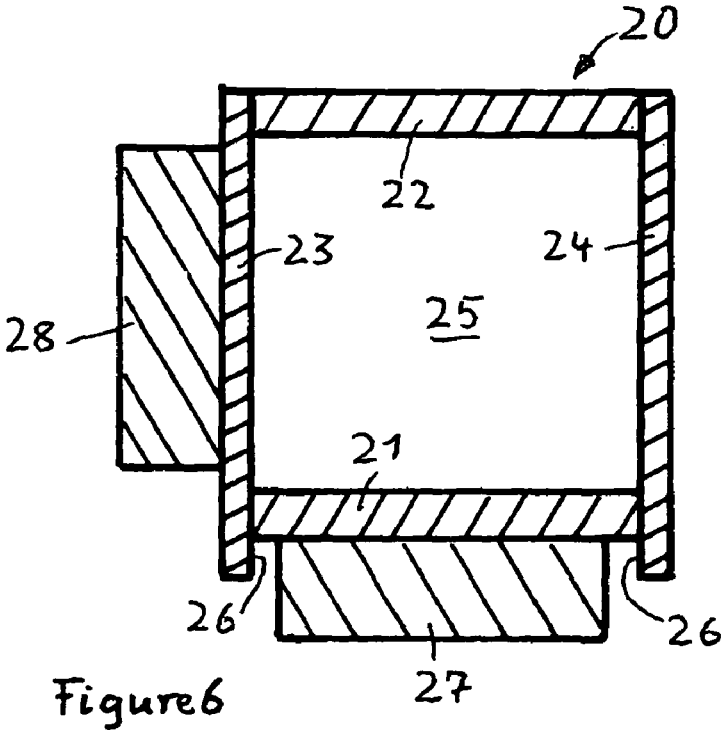
FIG. 6: the view of a cross-section through a corner structural component for insertion in a construction set according to the invention and a structure according to the invention together with wooden structural components of the type according to the FIGS. 1 to 5.

The corner structural component depicted in FIGS. 6 and 7 of the drawings consists in its featuring a column 20, square in its cross-section, which is essentially composed of two front panels 21 and 22 arranged opposite each other, and two side panels 23 and 24 arranged opposite each other, preferably made of wooden material, and contains an insulation space 25 for the incorporation of insulating material between the panels. The front panels have a width roughly equal to the distance of the base plates of a wooden structural component joined together by supports, measured between the outer surfaces of the base plates. The side panels are wider than the front panels and protrude with exposed top edges 26 on at least one side over the outer surface of the one front panel 21. The width of the exposed top edges 26 of the side panels is roughly the same as the width of the exposed top edges 7, 8 on the outer surfaces of the base plates 1, 2.

A first connecting post 27 is fixed on the first front panel 21, in the middle between the exposed top edges 26 of the side panels. This post has a roughly rectangular cross-section with a cross-sectional length roughly equal to the gap between the base plates of a wooden structural component, which are joined to each other, measured between the inner surfaces of the base plates. Fixed to the one side panel 23, in the middle between top edges of the column aligned roughly vertical on the finished structure, is a second connecting post 28 with measurements roughly equal to the measurements of the first connecting post. In a finished structure, the connecting posts stretch along the top edges of the base plates of neighboring wooden structural components. They protrude into the cavity between the base plates and so join with a positive fit the neighboring wooden structural components to the corner structural component.

The lower ends of the connecting posts 27 and 28 have a distance from the lower end of the column 20 roughly equal to the width of the free longitudinal edges 5 and 6 on the outsides of the base plates 1 and 2, or on the insides of the wall panels 3 and 4. Depicted in FIG. 7 are a ground sill 29 in cross-section and a ground sill 30 in side view, aligned roughly at a right angle to it, schematically raised off the corner structural component. These ground sills have a width roughly the same as the gap between a wooden structural element's wall panels (3, 4) joined together by supports, measured between the inner surfaces of the wall panels. Their height is roughly the same as the width of the free longitudinal edges 5 and 6 on the outer surfaces of the base plates (1, 2), or on the inner surfaces of the wall panels (3, 4) of a wooden structural component. In a finished structure these ground sills should be laid out and fixed roughly at right angles to each other on a foundation base. Their ends which are directed towards a corner of the structure can be located under the lower ends of the connecting posts 27 or 28 of a corner structural component, and reinforce these posts. They are also dedicated, for example in wooden structural components of the embodiment type according to FIGS. 1 to 3 and 5, to sill up the space between the wall panels and the lower longitudinal front sides 15 of the base plates, to reinforce the base plates and so to join the lowest wooden structural components with the foundation base in a form-fit and force-fit manner. With a cross-sectional profile (not shown) in the form of levels, ground sills can also stretch between the base plates (1, 2) up to the lower ends of the supports 9 raised up by the longitudinal front sides 15, according to the invention, and can transfer vertical forces from these supports to the foundation base.

Wooden structural components of the embodiment type according to FIG. 4 require the insertion of ground sills with particular cross-section profiles on finished structures. Such ground sills are not in fact depicted here, but will be in the thoughts of those skilled in the art as a result of the descriptions of ground sills 29 and 30.

Wooden structural components and corner structural components are used inventively in the manufacture of structures in that, into the insulation spaces of the corner structural components and of the wooden structural components, first insulating materials with volumes which vary under the influence of atmospheric conditions and tremors are inserted or poured or blown or stuffed after grinding down the material, and that at least one permanently elastic second insulating material with an elasticity which remains as constant as possible and with volumes which change under pressure is arranged under and/or between and/or over the first insulating material. The second insulating material has equal shrinkage to the insulating material on other positions and so prevents the build-up of thermal bridges through insulation spaces or filling with insulating material. Particularly ecological requirements can thereby be advantageously met in that organic natural raw materials, preferably rock flour or granulates like clays, sands and/or pebbles, are inserted. Upon insertion of one of the first insulating materials of the type of particularly dense and heavy bulk goods which form heaps which keep their own shape, alongside the insertion of further first insulating materials with particularly advantageous thermodynamic properties regarding the heat and steam permeability, there emerge structures according to the invention, which withstand nearly every known hazard.

The invention claimed is:

1. A wooden structural component for manufacture of a flat structure, comprising two rectangular base plates of roughly a same size, aligned substantially parallel to each other, maintained to define a cavity therebetween and overlapping each other in a projection normal to main surfaces of the base plates, two rectangular wall panels of roughly a same size, aligned approximately parallel to each other, which are fixed in a projection normal to main surfaces of the wall panels, each wall panel being mounted on an outer surface of one base plate, and which are approximately a same size or a slightly smaller size than the base plates, the base plates and the wall panels each have longitudinal edges which are aligned approximately horizontal and parallel to each other, and top edges being aligned approximately vertically and parallel to each other, each wall panel being mounted to a respective base plate in an offset manner such that a portion of the outer surfaces of the base plates is exposed to define tongue joints arranged approximately at right angles to each other, and the wall panels protrude over longitudinal edges of the base plates, and protrude over top edges of the base plates to expose a portion of an inner surface of the wall panels to define corresponding groove joints arranged approximately at right angles to each other, approximately as opposites of the tongue joints, elongated longitudinally-stretched supports arranged in a cavity approximately parallel to each other and to the top edges of the base plates, and arranged approximately perpendicular to the longitudinal edges of the base plates, and whose length is approximately the same as the length of the top edges of the base plates or wall panels on the side, the supports being arranged at equal distances from each other, and such that a first distance of a first support from the nearest top edge of the base plates directly joined to a first support, and a second distance of a last support to a nearest top edge of the base plate directly joined to the last support, complement each other, the supports feature a rectilinear mid-profile with a substantially right-angled cross section and form retaining walls between the base plates approximately at right angles thereto, which subdivide the cavity between the base plates into chambers of roughly equal size, the supports feature tongue joints along edge sides, which fit into approximately equal and opposite grooves on the inner surface of the base plates to form a form-fitting connection between the supports and the base plates, the supports being arranged offset in relation to the longitudinal edges of the base plates, with the tongue joints partially engaged in opposite grooves on the base plates, and the base plates located opposite each other partially joining each other, the supports include approximately equally long free end pieces with approximately equally long free tongue joints, which protrude over a first of two longitudinal front sides of the base plates located opposite each other, the longitudinal front sides each being delimited by two longitudinal edges of the base plates located nearest each other, and the grooves include free end pieces in the base plates which are accessible from a second of the two longitudinal front sides and which are dedicated to incorporating the tongue joint of one of the free end pieces of a neighboring wooden structural component of a same kind on the flat structure.

2. The wooden structural component according to claim 1, used in the manufacture of walls of buildings with installation spaces, separated by isolation spaces, between inner and outer base plates, partition walls are inserted aligned between the supports approximately parallel to the base plates which feature approximately horizontally-aligned longitudinal edges and vertically-aligned top edges, and which are held along a length of both sides of vertical top edges on retaining walls of the supports turned towards each other.

3. The wooden structural component according to claim 2, wherein the partition walls with top frames running along the top edges are formed, which are dedicated to being incorporated in grooves on the retaining walls of the supports.

4. The wooden structural component according to claim 3, wherein the grooves on the retaining walls include an opening width in a range from 3 to 8 millimeters for incorporating the top frames of partition walls, and the grooves on the retaining walls are at a distance of 20 to 30 millimeters from one base plate, and at a distance of 150 to 250 millimeters from the other base plate.

5. The wooden structural component according to claim 2, wherein essentially rectangular-formed partition walls include lateral top edges with a length equal to a length of the supports.

6. The wooden structural component according to claim 5, wherein the longitudinal edges of the rectangular-formed partition walls are arranged in an insertion between the supports flush to the ends of the supports.

7. A corner structural component for insertion into a structure and a building in connection with wooden structural components according to claim 1, wherein the corner structural component includes a column with an approximately rectangular, cross-section, which is essentially composed of two front panels arranged opposite each other and two side panels arranged opposite each other, and the corner structure component contains an insulation space for incorporating insulating material between the panels, the front panels have a width equal to a gap between the base plates, joined to each other by supports, of a wooden structural component measured between outer surfaces of the base plates, the side panels are wider than the front panels and mainly protrude on one side with exposed top frames over the outer surfaces of a first of the two front panels, the width of the exposed top frames is roughly a same as a width of the exposed top frames on the outsides of the base plates of a wooden structural component, a first connecting post is fixed on at least the first of the two front panels in a middle between the exposed top frames of the side panels, the approximately rectangular cross-section of which has a length approximately equal to the gap between the interconnected base plates of a wooden structural component measured between the inner surfaces of the base plates, and a second connecting post with measurements approximately equal to measurements of the first supporting post is fixed on the second front panel and/or at least on one of the two side panels in the middle between top edges of the column aligned roughly vertically on the finished structure.

8. The corner structural component according to claim 7, wherein lower ends of the connecting posts feature a distance from lower ends of the columns roughly equal to the width of the free longitudinal frames on the outer sides of the base plates, or on the inner sides of the wall panels of a wooden structural component.

9. The corner structural components according to claim 7, wherein first insulating materials are inserted or poured or blown or stuffed by diminution into the insulation spaces of the corner structural components, and at least one permanently elastic second isolating material arranged under and/or between and/or over the first insulating materials, the first insulating materials permit swelling or shrinking in response to atmospheric conditions and tremors, and the second material exhibits permanent elasticity shrinking in increased pressure and swelling under decreased pressure.

10. The corner structural components according to claim 9, wherein insertion of particularly dense and heavy bulk goods which form heaps which keep their own shape as one of the first insulating materials, together with the insertion of further first insulating materials with particularly advantageous thermodynamic properties regarding heat and steam permeability.

11. The wooden structural components according to claim 1, wherein first insulating materials are inserted or poured or blown or stuffed by diminution into the insulation spaces the wooden structural components delimited by retaining walls and partition walls, and at least one permanently elastic second isolating material arranged under and/or between and/or over the first insulating materials, the first insulating materials permit swelling or shrinking in response to atmospheric conditions and tremors, and the second material exhibits permanent elasticity shrinking in increased pressure and swelling under decreased pressure.

12. The wooden structural components according to claim 11, wherein insertion of particularly dense and heavy bulk goods which form heaps which keep their own shape as one of the first insulating materials, together with the insertion of further first insulating materials with particularly advantageous thermodynamic properties regarding heat and steam permeability.

13. The wooden structural component according to claim 1, wherein the flat structure is for construction of a wall of a building.

14. The wooden structural component according to claim 1, wherein the grooves are dovetail grooves.

15. The wooden structural component according to claim 1, wherein the tongue joints are dovetail joints.

16. The wooden structural component according to claim 3, wherein the grooves on the retaining walls feature an opening width in a range from 3 to 8 millimeters for incorporating the top frames of partition walls, and the grooves on the retaining walls are at a distance of 20 to 25 millimeters, from one base plate, and at a distance of around 200 millimeters, from the other base plate.

17. The corner structural component according to claim 7, wherein the column has a square cross-section.

18. The corner structural component according to claim 7, wherein the side panels are made of wooden material.

* * * * *